US006743079B2

(12) United States Patent
Bown et al.

(10) Patent No.: US 6,743,079 B2
(45) Date of Patent: Jun. 1, 2004

(54) PRECISION PORTABLE FLANGE GRINDER

(75) Inventors: Roger A. Bown, Seattle, WA (US); Michael L. Watts, Tacoma, WA (US)

(73) Assignee: The Boeing Company, Chicago, IL (US)

( * ) Notice: Subject to any disclaimer, the term of this patent is extended or adjusted under 35 U.S.C. 154(b) by 58 days.

(21) Appl. No.: 10/128,803

(22) Filed: Apr. 23, 2002

(65) Prior Publication Data

US 2003/0199237 A1 Oct. 23, 2003

(51) Int. Cl.[7] ..... B24B 1/00
(52) U.S. Cl. ..... 451/51; 451/57
(58) Field of Search ..... 451/51, 57, 28, 451/441, 348, 439, 438; 29/888.07, 888.075, 888.076

(56) References Cited

U.S. PATENT DOCUMENTS 1,464,728 A 8/1923 Ross
1,997,639 A 4/1935 Hetherington et al.
2,257,619 A 9/1941 Prill
2,818,695 A 1/1958 Lockwood
2,869,293 A * 1/1959 Howard ..... 451/439
4,086,732 A * 5/1978 Ramsey ..... 451/49

* cited by examiner

*Primary Examiner*—Dung Van Nguyen
(74) *Attorney, Agent, or Firm*—Black Lowe & Graham PLLC

(57) ABSTRACT

A portable precision flange grinder grinds a flange on a duct. The flange has an axis, a radius, and a periphery. A mount mounts the grinder within the duct. The mount attaches to openings at ends of the duct. A grinding wheel grinds a flange on a duct and arranged to rotate along a periphery of the flange. A first linkage translates the grinding wheel along an axis of the flange to bring the grinding wheel laterally in grinding contact with the flange. The first linkage engages with the mount along an axis of the flange. A second linkage translates the grinding wheel along a radius of the flange bringing the grinding wheel radially in grinding contact with the flange. The second linkage attaches to the first linkage. A bearing assembly rotates the grinding wheel about the periphery of the flange. The bearing assembly is attached to the first linkage.

20 Claims, 3 Drawing Sheets

PRECISION PORTABLE FLANGE GRINDER

FIELD OF THE INVENTION

This invention relates generally to metal forming and, more specifically, to grinding.

BACKGROUND OF THE INVENTION

Modern manufacturers carry as small an inventory of parts as possible to construct a product. By limiting the number of parts carried in inventory, a manufacturer can reduce overhead and minimize capital by removing the need for storage of excess inventory. This "just-in-time" philosophy of manufacturing has become the world-wide standard for manufacturers of most products.

While "just-in-time" production practices have saved millions of dollars, those same practices can be intensely expensive where no substitute exists for a needed part. Even with rigorous standards for quality control the possibility exists that a needed part may be outside of the specifications necessary. For example, imperfections may occur in component parts fabricated from exotic metals that require for formation high heat or pressure. Where such imperfections occur, economic realities may make modification of an existing, out-of-specification part more feasible than shutting down a manufacturing line while a part within specifications is fabricated.

An example of such an instance exists in the aircraft industry. In the construction of commercial airplanes, the price of the engines may comprise up to 25% of the total production costs. Each aircraft engine, after assembly, must undergo extensive testing for certification. The engines are delivered in their assembled state with appropriate attachment points for various connections to existing systems within the airframe.

Included in these connections is a duct for high temperature or high-pressure "bleed" gasses. Generally, this duct is made of inconel—a nickel chromium alloy with good oxidation resistance at high temperatures. This inconel duct is welded at one end to the engine and terminates at the other end with a large flange for mating onto a second duct where the engine mounts to the airframe. In the course of duct fabrication or subsequent welding the duct to the engine some deformation of the flange for mating to the airframe may occur. When this flange is no longer within tolerance of the specification for the mating junction, the known practice includes tearing down the engine; removing the inconel duct; replacing or machining the duct back into tolerances; re-welding the duct to the engine; reassembling the engine; re-testing and certifying the engine; and returning the engine to its mount on the airframe.

Due to the high cost of aircraft engines, mounting and installing the engines is the last substantial step before delivering a completed commercial airliner to its prospective owner. Under known techniques, a deformed flange delays the engine installation causing the airframe to sit idle, waiting for the rebuilt engine. That idle time is costly in terms of both resources as well as customer satisfaction.

There exists, then, an unmet need in the art for machining ducting in place without necessitating the disassembly of the engine.

SUMMARY OF THE INVENTION

The present invention allows for precision grinding of flanges without disassembly of the attached mechanism. In the case of aircraft engines, use of the present invention to correct defects in flanges removes necessity of tear-down, rebuilding, and subsequent FAA recertification of attached engines.

A portable precision flange grinder grinds a flange on a duct. The flange has an axis, a radius, and a periphery. A mount mounts the grinder within the duct. The mount attaches to openings at ends of the duct. A grinding wheel grinds a flange on a duct and arranged to rotate along a periphery of the flange. A first linkage translates the grinding wheel along an axis of the flange to bring the grinding wheel laterally in grinding contact with the flange. The first linkage engages with the mount along an axis of the flange. A second linkage translates the grinding wheel along a radius of the flange bringing the grinding wheel radially in grinding contact with the flange. The second linkage attaches to the first linkage. A bearing assembly rotates the grinding wheel about the periphery of the flange. The bearing assembly is attached to the first linkage.

In accordance with further aspects of the invention, the present invention can remove defects that have occurred in the course of mounting or transporting a larger mechanism to which the flanged piece is attached. According to one aspect of the invention, the flange is affixed to an aircraft engine. However, according to other aspects of the invention, the present invention machines any flange that is circular in shape. Further, the base plug seals of the component against contamination by grinding debris.

According to other aspects of the invention, the present invention is adaptable to any metallic flange. The present invention further operates on suitably rigid non-metallic materials, such as plastic, to the extent that such materials are susceptible to grinding operations.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, a portable precision flange grinder grinds a flange on a duct. The flange has an axis, a radius, and a periphery. A mount mounts the grinder within the duct. The mount attaches to openings at ends of the duct. A grinding wheel grinds a flange on a duct and arranged to rotate along a periphery of the flange. A first linkage translates the grinding wheel along an axis of the flange to bring the grinding wheel laterally in grinding contact with the flange. The first linkage engages with the mount along an axis of the flange. A second linkage translates the grinding wheel along a radius of the flange bringing the grinding wheel radially in grinding contact with the flange. The second linkage attaches to the first linkage. A bearing assembly rotates the grinding wheel about the periphery of the flange. The bearing assembly is attached to the first linkage.

Figure 1:
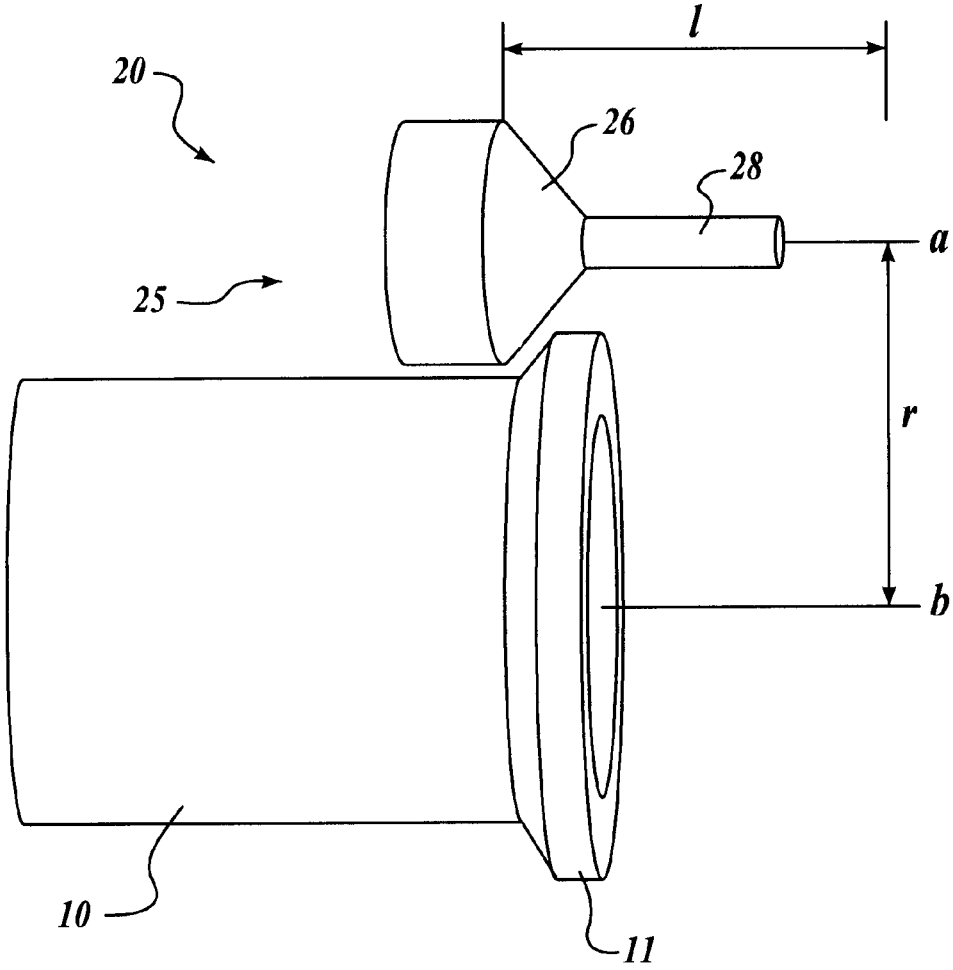
FIG. 1 is a perspective view of a duct and a grinding wheel.

Referring to FIG. 1, a flange grinder 20 includes a grinding wheel 25 with a face 26 that is mounted on a shaft 28 having an axis a. The face 26 is a cutting surface at the wheels. The flange grinder 20 defines and maintains a spatial relationship between an axis b of a piece such as a duct 10, and the grinding wheel 25. That is, the grinder 20 maintains the axis a parallel to the axis b. The grinder 20 also varies a radial distance r between the axis a and the axis b. Further, the grinder 20 moves the grinding wheel 25 a distance l along the duct 10. By maintaining these spatial relations and by varying the position of the grinding wheel 25 by changing the radial distance r and l, the face 26 will meet the duct 10 and precisely machine an flange 11 on the duct 10. It will be appreciated that the "dress" of the grinding wheel 25, that is the angle of the face 26 will determine the angle placed on the flange 11 by the action of the grinding wheel 25.

Figure 2:
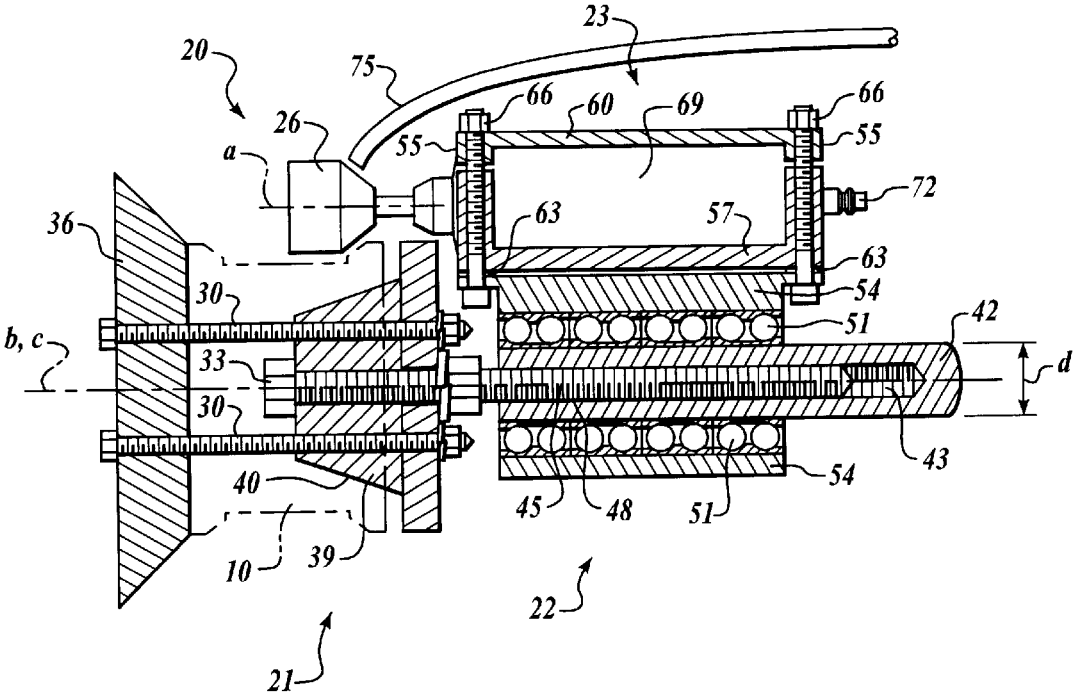
FIG. 2 is a cross-section view of the present invention.

FIG. 2 is a cross-section of one presently preferred embodiment of the invention. In order to maintain alignment with the duct 10, the grinder 20 includes a base assembly 21. The base assembly 21 includes three components: a base plate 36 for insertion in the duct 10 in order to gain a purchase on the duct material; a base plug 39 for aligning the base assembly 21 with the axis b and thus allowing precise grinding of the flange 11; and fasteners 30 which span a gap between the base plate 36 and the base plug 39. In FIG. 2, the base plate 36 is shown as a trapezoidal prism having a minor base 37. While other shapes are suitably used, the trapezoidal prism is a presently preferred embodiment. This is because of a trapezoid's ability to gain a fixed position inside the interior cavity of several distinctly shaped ducts 10 with the minor base 37 facing toward the base plug. A self-centering effect is therefore achieved by the sloping sides of the base plate 36. It will be appreciated that the dimensions of the shape of the base plate 36 can be varied in order to optimize the performance of the invention with varying shapes of the duct 10.

The base plug 39 is preferably a truncated cone having an axis c and a narrower section 40 inserted into the duct 10. The truncated conical shape of the base plug 39 has several advantages. The plug 39 tends to center itself in a circular opening in the duct 10 under tension and assume a position such that the axis c is co-axial with the axis b.

The base fasteners 30 are suitably bolts with long shanks to pass through the trapezoidal base plate 36, the duct 10, and the base plug 39. The base fasteners 30 provide tension between the base plate 36, with its purchase on the duct 10, and the base plug 39. As a result of this tension, the base plug 39 comes into precise alignment with the opening of the duct 10. This provides a stable base that is properly located for grinding the flange.

A spindle 33 extends along the axis c and outward from the duct 10. The spindle 33 is suitably a long bolt passing through the base plug 39 and having a threaded shaft 45 and an axis b. The bearing assembly 22 rotates around the spindle 33 to provide circular motion to grind all sides of the duct 10. In a presently preferred embodiment, an adjusting handle 42 defines a cavity 43 with internal threads 48 (shown in phantom). The threads 48 engage the threaded shaft 45 in a manner to allow translational travel along axis b (and therefore aligned with the axis c) by means of rotating the handle 42. It will be appreciated that any acceptable linear bearing assembly known in the art will achieve this same ability to translate the bearing assembly 22, along axis b. However, to ensure a rigid mounting and translation of the grind wheel the linear bearing assembly may incorporate an interference fit between the inner housing diameter 54, the ball bearings 51, and the shaft diameter d. A rigid set-up is preferable to maintain the required flange surface finish.

Affixed to the outer surface of the adjusting handle are a plurality of bearings 51 that allow rotation about the spindle 33. Fixed to the outer surface of the bearings 51 is a housing 54 that encloses the bearings 51 and provides an anchoring point for a grinder assembly 23.

The grinder assembly 23 securely holds a pneumatic grinder 69, powered by compressed gas feed through a quick release fitting 72. The pneumatic grinder 69 includes a grinding wheel 25 with the face 26 that is mounted on the shaft 28 with the axis a. In one embodiment, the grinder assembly 23 is fixed to the housing 54 by means of cradle fasteners 66 that pass through flanges 55 on the housing 54, through a series of shims 63, a cradle base 57, and a cradle bracket 60. The shims 63 are suitably selected to vary the radial distance r (FIG. 1) between the axis a and the axis b. Shims are a preferred embodiment though several means exist to adjust this distance including shims, threaded rods, or adjustable racks. The shims 63 are selected to optimize the position of the grinding wheel 25 and the shaft 28 as they extend out of the grinder 69. The grinder assembly 23 is fastened by tightening the cradle fasteners 66. The motion of the grinder assembly 23 is accomplished by either translating the bearing assembly 22 by rotating the handle 42 or by "feeding"—that is, rotating the grinder assembly 23 about the spindle 33 around the perimeter of the duct 10 and minimize thermal expansion, so precision flange tolerances can be maintained.

A cool air feed 75 suitably provides a supply of cool air to be entrained along the face 26, thus creating a cooling vortex. This cooling vortex optimizes the contact temperature of the grinding wheel 25. This prevents a change in the temper of the metal constituting the duct 10.

Figure 3:
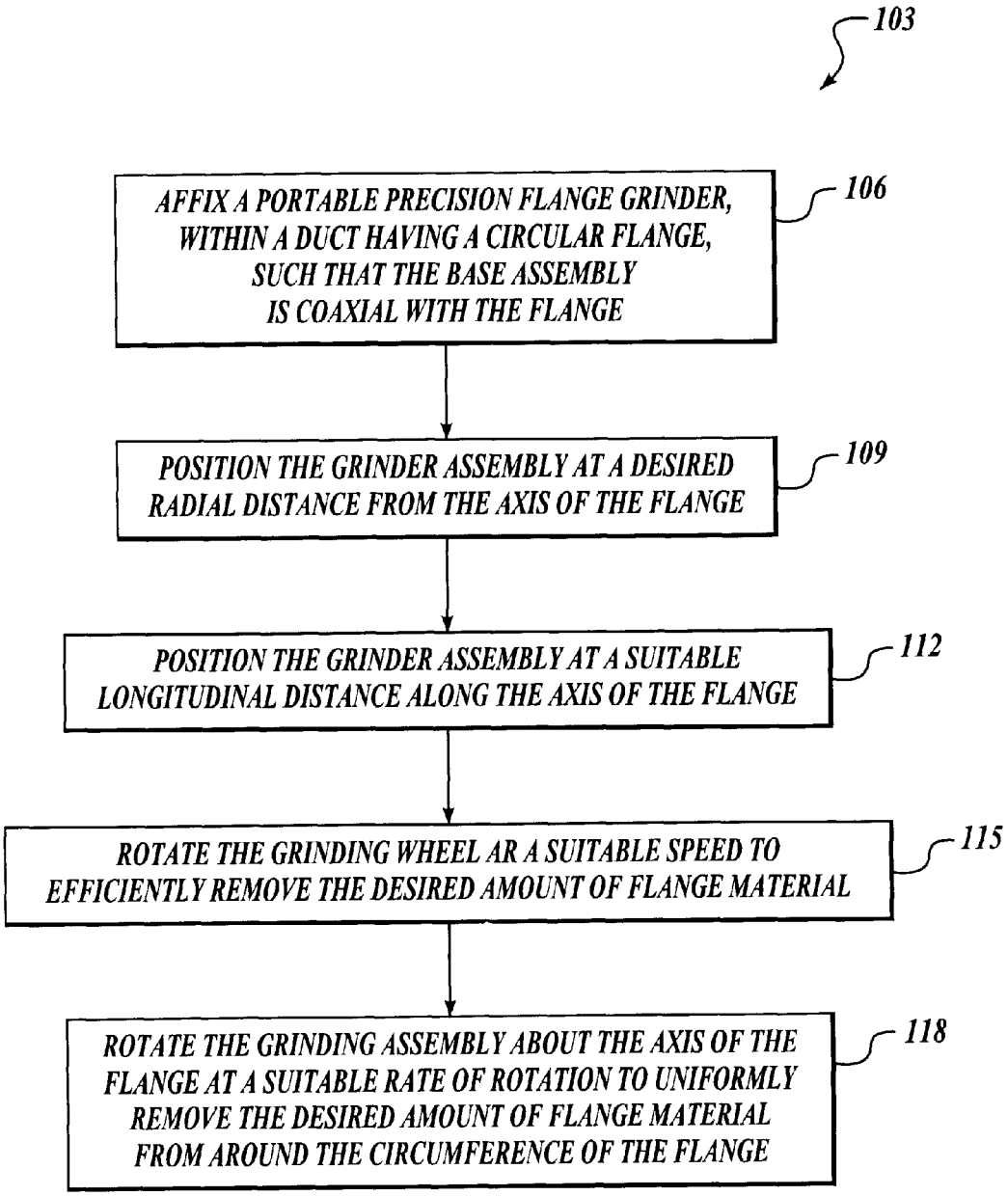
FIG. 3 is a flow chart of a routine for use of the present invention.

Refering now to FIGS. 1, 2, and 3, a method 103 for using the present invention begins at a block 106. At the block 106, the base assembly 21 is affixed within the duct 10 having a circular flange 11 such that the base is co-axial with the flange 11. This fixation entails the base assembly 21 being co-axial with the duct 10. At a block 109, the grinder assembly 23 is positioned at a desired radial distance r from the axis b of the duct 10.

At a block 112, longitudinal distance along the duct 10 is adjusted for optimum contact between the face 26 and the flange 11. At a block 115, the grinder assembly 23 is rotated about the duct 10 to remove the desired amount of flange material. The rotation of the grinder assembly 23 about the axis b occurs at a rate suitable to remove the desired amount of flange material.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A portable precision flange grinder for grinding a flange on a duct, the flange having an axis, a radius, and a periphery, the grinder comprising:

a mount arranged for mounting the grinder within the duct, the mount being removably attachable to openings at ends of the duct;

a grinding wheel for grinding a flange on a duct, the grinding wheel being arranged to rotate along a periphery of the flange;

a first linkage for laterally translating the grinding wheel along an axis of the flange to bring the grinding wheel laterally in grinding contact with the flange, the first linkage being laterally engageable with the mount along an axis of the flange;

a second linkage for radially translating the grinding wheel along a radius of the flange to bring the grinding wheel radially in grinding contact with the flange, the second linkage being fixedly attachable to the first linkage and adjustably supporting the grinding wheel along the radius of the flange; and a bearing assembly for rotating the grinding wheel about the periphery of the flange, the bearing assembly being rotatably attachable to the first linkage and fixedly supporting the grinding wheel about the periphery of the flange.

2. The grinder of claim 1, wherein the mount includes a base plug for mounting the grinder within the duct, the base plug having an axis aligned with an axis of the flange.

3. The grinder of claim 2, wherein the base plug is a truncated cone.

4. The grinder of claim 2, wherein the first linkage includes a spindle affixed to the base plug, the spindle having an axis aligned with the axis of the flange.

5. The grinder of claim 4, wherein the spindle includes a threaded shaft.

6. The grinder of claim 5, wherein the first linkage includes an adjusting knob in threaded contact with the threaded shaft, such that rotation of the adjusting knob laterally translates the grinder along the axis of the flange.

7. The grinder of claim 1, wherein the second linkage includes shims insertable along a radius of the flange.

8. The grinder of claim 1, further comprising a conduit arranged to provide a stream of air for cooling the flange.

9. A method for grinding a flange on a duct, the flange having a periphery, an axis, and a radius, the method comprising:

mounting a grinder assembly within a duct, the duct having a flange formed thereon, the grinder assembly including a grinding wheel that is arranged to rotate outside of the duct;

rotating the grinding wheel;

radially translating the grinder assembly along a radius of the flange to bring the grinding wheel in grinding contact with the flange;

laterally translating the grinder assembly along an axis of the flange to bring the grinding wheel into grinding contact with the flange; and rotating the grinding assembly about a periphery of the flange.

10. The method of claim 9, wherein radially translating the grinder assembly includes providing shims along the radius of the flange.

11. The method of claim 10, wherein mounting the grinder assembly includes inserting a base plug within the duct, an axis of the base plug being aligned with the axis of the flange.

12. The method of claim 11, wherein laterally translating the grinder assembly includes rotating an adjusting knob engaged in threaded contact with a threaded spindle affixed to the base plug, an axis of the threaded spindle being aligned with the axis of the flange.

13. The method of claim 10, further comprising providing a stream of cooling air for cooling the flange.

14. A portable precision flange grinder for grinding a flange on a duct, the flange having an axis, a radius, an opening, and a periphery, the grinder comprising:

a mount arranged for mounting the grinder within the duct, the mount being removably attachable to openings at ends of the duct including:

a base plug for aligning the axis of the mount with an axis of the flange when a biasing force is applied;

a base plate for securing the mount within the duct; and a plurality of base fasteners connecting the base plate to the base plug such that the fasteners apply the biasing force between the base plug and the base plate;

a grinding wheel for grinding a flange on a duct, the grinding wheel being arranged to rotate along a periphery of the flange;

a first linkage for laterally translating the grinding wheel along an axis of the flange to bring the grinding wheel laterally in grinding contact with the flange, the first linkage being laterally engageable with the mount along an axis of the flange;

a second linkage for radially translating the grinding wheel along a radius of the flange to bring the grinding wheel radially in grinding contact with the flange, the second linkage being fixedly attachable to the first linkage and adjustably supporting the grinding wheel along the radius of the flange; and a bearing assembly for rotating the grinding wheel about the periphery of the flange, the bearing assembly being rotatably attachable to the first linkage and fixedly supporting the grinding wheel about the periphery of the flange.

15. The grinder of claim 14, wherein the base plug is a truncated cone.

16. The grinder of claim 14, wherein the linkage includes a spindle affixed to the base plug, the spindle having an axis aligned with the axis of the flange.

17. The grinder of claim 16, wherein the spindle includes a threaded shaft.

18. The grinder of claim 17, wherein the linkage includes an adjusting knob in engaged in threaded contact with the threaded shaft, such that rotation of the adjusting knob will translate the grinder along the axis.

19. The grinder of claim 14, wherein the carriage includes shims insertable along the radius of the flange.

20. The grinder of claim 14, further comprising a conduit arranged to provide a stream of air for cooling the flange.

* * * * *